US006875365B2

(12) United States Patent
Watanabe et al.

(10) Patent No.: US 6,875,365 B2
(45) Date of Patent: Apr. 5, 2005

(54) METHOD FOR PRODUCING LIQUID DISCHARGE HEAD

(75) Inventors: Hidenori Watanabe, Kanagawa (JP); Yukihiro Hayakawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 10/145,202

(22) Filed: May 15, 2002

(65) Prior Publication Data

US 2003/0034326 A1 Feb. 20, 2003

(30) Foreign Application Priority Data

May 15, 2001 (JP) ..... 2001-144124

(51) Int. Cl.[7] ..... B41J 2/16

(52) U.S. Cl. ..... 216/2; 216/27; 216/62; 216/87; 216/99

(58) Field of Search ..... 216/2, 27, 62, 216/87, 99

(56) References Cited

U.S. PATENT DOCUMENTS 5,565,084 A * 10/1996 Lee et al. ..... 205/646
6,139,761 A 10/2000 Ohkuma ..... 216/27
6,143,190 A 11/2000 Yagi et al. ..... 216/27

FOREIGN PATENT DOCUMENTS

JP 9-11479 1/1997

* cited by examiner

*Primary Examiner*—Anita Alanko
(74) *Attorney, Agent, or Firm*—Fitzpatrick, Cella, Harper & Scinto

(57) ABSTRACT

A method for producing a liquid discharge head provided with a discharge port for discharging liquid, a liquid flow path communicating with the discharge port, and a silicon substrate including a discharge energy generating element for generating energy for liquid discharge and a liquid supply aperture for supplying the liquid flow path with the liquid, the method comprising following steps of: forming an anisotropic etching stop layer in a portion wherein the liquid supply apertures is to be formed on the top side of the substrate; forming an insulation layer on the anisotropic etching stop layer; destructing the crystalline structure under the etching stop layer in the liquid supply aperture forming portion utilizing the insulation layer as a mask, forming, on the rear side of the substrate, an etching mask layer having an aperture corresponding to the liquid supply aperture forming portion on the top side, etching the substrate by anisotropic etching from the aperture until the area where the crystalline structure is destructed is exposed; further etching the area where the crystalline structure is destructed from the portion exposed by the anisotropic etching step thereby exposing the anisotropic etching stop layer; and eliminating the exposed anisotropic etching stop layer.

6 Claims, 8 Drawing Sheets

METHOD FOR PRODUCING LIQUID DISCHARGE HEAD

BACKGROUND OF THE INVENTION

1. Field of the Invention

The present invention relates to a liquid discharge head for discharging liquid such as ink from a discharge port as a flying liquid droplet to form a record or an image on a recording medium, and a method for producing the same.

2. Related Background Art

The conventional ordinary liquid discharge head is provided with plural fine discharge ports for discharging liquid such as ink, liquid flow paths communicating with the discharge ports and a discharge energy generating element provided in each liquid flow path, and is so constructed as to provide the discharge energy generating element with a drive signal corresponding to recording information or image information thereby supplying the liquid in the liquid flow path corresponding to the discharge energy generating element with discharge energy to discharge the liquid as a flying liquid droplet from the discharge port thus achieving print recording or image formation. In such liquid discharge head of so-called side shooter type in which the liquid droplet is discharged in a direction perpendicular to the plane bearing the discharge energy generating element, there is adopted a configuration, as shown in FIG. 16, of forming a penetrating liquid discharge aperture 113 in a substrate 111 bearing the discharge energy generating element 112 and executing liquid supply from the rear side of the substrate. In FIG. 16, there are shown a liquid flow path 114, a discharge port 115 formed corresponding to each discharge energy generating element 112, a width d of the liquid supply aperture 113 at the top side of the substrate, and a distance L from the end of the liquid discharge aperture 113 to the center of the discharge energy generating element 112, wherein the liquid flow is represented by a chain line.

In the liquid discharge head of such side shooter type, a method of forming the liquid discharge aperture 113 by anisotropic etching of the Si substrate 111 is disclosed for example in the Japanese Patent Application Laid-open No. 9-11479. In such process for forming the liquid supply aperture, a Si substrate 101 having 100 orientation on the surface is employed as the substrate, and, as shown in FIG. 14A, etching mask layers 102 are formed on both sides of the Si substrate 101, and the etching mask layers 102 on the rear side is eliminated in a desired position for forming the penetrating hole constituting the liquid supply aperture (FIG. 14B). Then Si is anisotropically etching with anisotropic Si etching solution such as TMAH (tetramethylammonium hydroxide) aqueous solution whereby 111 crystalline surface of Si is exposed to form a penetrating hole 113 having a plane inclined by 54.7° to the substrate surface.

Si substrate is associated with unevenness in the size and density of defects therein, because of fluctuation in the Oi (interlattice oxygen) concentration among wafers and within wafer, present even in the stage of single crystal formation, and fluctuation in the thermal process among wafers and within wafer, applied in the course of semiconductor device formation.

In the presence of such unevenness in the size and density of defects in the Si substrate, the penetrating hole 103 formed by anisotropic etching becomes inversely tapered in the vicinity of the rear surface of the Si substrate 107, as shown in FIG. 14C. This is because the etching is not dependent on the crystalline orientation in an area having a relatively high density of the crystal defects in the vicinity of the rear surface (range of 20 to 150 μm from the rear surface) of the Si substrate 101. Also similar anisotropic Si etching is executed from the rear surface with etching masks of a same size over the wafer surface, the aperture width d of the penetrating hole 103 on the top surface fluctuates such as $d_1$, $d_2$, $d_3$ as shown in FIG. 14C ($d_1>d_2>d_3$ in the illustration) whereby the finished dimension of the penetrating hole varies depending on the location. Such dimensional fluctuation results from the unevenness in the etching rate based on the unevenness in the size and density of the defects, and the dimensional fluctuation of the penetrating hole constituting the liquid supply aperture amounts to 40 to 60 μm between the maximum and minimum values of the aperture width d within the same plane. The aperture width d of the penetrating hole is also influenced by the fluctuation in the thickness of the silicon substrate and in the concentration of the etching solution.

In the liquid discharge head of side shooter type prepared by forming the liquid supply aperture by anisotropic etching in the Si substrate, as shown in FIG. 15, there will result a fluctuation in the aperture width d of the liquid supply aperture 113 on the top side of the substrate bearing the discharge energy generating elements, even within a liquid discharge head of a single chip. Such fluctuation leads to a fluctuation in the distance L (cf. FIG. 16) from the end of the liquid supply aperture 113 to the discharge energy generating element 112. In FIG. 15, a solid line indicates the state of opening of the liquid supply aperture 113 on the top side in case of actual anisotropic Si etching from the rear side, while a chain line indicates the ideal opening state of the liquid supply aperture 113 calculated from the dimension of the etching mask. Also a broken line 117 indicates the aperture of the etching mask formed on the rear side of the substrate 111.

In the liquid discharge head provided with the liquid supply aperture involving such fluctuation in the aperture width on the top side, there will result variation in the distance L between the end of the liquid supply aperture and the discharge energy generating element and in the flow resistance for the liquid flowing in such portion, thereby resulting in a significant influence on the working frequency characteristics of the liquid discharge head.

As explained in the foregoing, in the method of forming the liquid supply aperture in which the aperture width thereof is determined by the etching mask on the rear side of the wafer, there results fluctuation in the aperture width d of the liquid supply aperture and in the distance L between the end of the liquid supply aperture and the discharge energy generating element because of the fluctuation in the thickness of the silicon substrate and in the concentration of the etching solution and also because of the unevenness in the size and density of the defects in the silicon substrate, thereby rendering the liquid supply characteristics of the discharge energy generating elements uneven and causing significant influence on the operating frequency characteristics of the liquid discharge head.

Consequently there is desired technology for forming the liquid supply aperture, capable of improving the precision of the distance between the end of the liquid supply aperture and the discharge energy generating element.

In this regard, the U.S. Pat. No. 6,143,190 discloses a method of forming a through hole in a silicon substrate comprising (a) a step of forming, in a portion on the surface of the substrate where the through hole is to be formed, a sacrifice layer enabling selective etching with respect to the material of the substrate, (b) a step of forming a passivation layer having etching resistance on the substrate so as to cover the above-mentioned sacrifice layer, (c) a step of forming an etching mask layer having an aperture corresponding to the sacrifice layer on the rear surface of the substrate, (d) a step of etching the substrate by crystal axis anisotropic etching from the above-mentioned aperture until the sacrifice layer becomes exposed, (e) a step of eliminating the sacrifice layer by etching from the portion exposed by the aforementioned substrate etching step, and (f) a step of eliminating a part of the passivation layer thereby forming a through hole.

In the above-mentioned patent application, the sacrifice layer is formed either by forming and patterning a polysilicon layer or by epitaxial growth of silicon, but the formation and pattern of polysilicon layer require an additional mask for pattern and may result in aberration in patterning. Also epitaxial growth of silicon requires a complex apparatus and cannot be easily achieved with a low cost.

SUMMARY OF THE INVENTION

In consideration of the foregoing, the object of the present invention is to provide a method for producing a liquid discharge head, capable of forming the aperture width of the liquid supply aperture in the liquid discharge head of side shooter type, easily and constantly with a high precision, regardless of the state of the Si substrate constituting the liquid discharge head.

The above-mentioned object can be attained, according to the present invention, by a method for producing a liquid discharge head provided with a discharge port for discharging liquid, a liquid flow path communicating with the discharge port, a discharge energy generating element for generating energy for liquid discharge and a silicon substrate including a liquid supply aperture for supplying the liquid flow path with the liquid, the method comprising a step of destructing the crystalline structure in a liquid supply aperture forming portion on the top side of the substrate, a step of forming, on the rear side of the substrate, an etching mask layer having an aperture corresponding to the liquid supply aperture forming portion on the top side, a step of etching the substrate by anisotropic etching from the aforementioned aperture until an area where the crystalline structure is destructed is exposed, and a step of eliminating the area where the crystalline structure is destructed by etching from the portion exposed by the anisotropic etching.

In the method of the present invention for producing the liquid discharge head, the destruction of the crystalline structure in the liquid supply aperture forming portion on the top side of the substrate is preferably executed by implantation of impurity ions utilizing, as a mask, a silicon oxide film, a PSG film, a BPSG film, a plasma oxide film or the like formed in a desired portion on the surface of the substrate.

In the method of the present invention for producing the liquid discharge head, the anisotropic etching of the silicon substrate and the etching of the area where the crystalline structure is destructed are preferably achieved with TMAH aqueous solution.

In the method of the present invention for producing the liquid discharge head, the aperture width of the liquid supply aperture on the top side is determined by the area on the top side of the substrate where the crystalline structure is destructed, and the aforementioned silicon substrate has a surfacial crystalline orientation of 100.

According to the present invention, the liquid supply aperture in the liquid discharge head of side shooter type is formed by executing implantation of impurity ions in the area determining the aperture width of the liquid discharge head on the top side to destruct the Si crystalline structure in such area, then executing anisotropic etching from the rear side of the substrate to the area where the crystalline structure is destructed, and eliminating the area where the crystalline structure is destructed by etching, utilizing the property of such area in which the etching rate is very high and the etching is isotropic. In this manner the aperture width of the liquid supply aperture on the top side can be determined in precise and simple manner, regardless of the state of Si crystal in the substrate. Also the aberration in mask cannot occur since the mask in impurity ion implantation can also be used as an insulation layer.

Consequently, in the liquid discharge head of side shooter type, the distance between the end of the liquid supply aperture and the discharge energy generating element can be obtained as designed whereby the liquid supply characteristics can be made uniform in the different discharge ports and there can be prepared the liquid discharge head with the desired operating frequency characteristics.

DETAILED DESCRIPTION OF THE PREFERRED EMBODIMENTS

Now the present invention will be clarified in detail by embodiments thereof, with reference to the accompanying drawings.

FIGS. 1, 2, 3, 4, 5, 6, 7, 8, 9, 10, 11 and 12 are schematic views showing steps in the method of the present invention for producing the liquid discharge head, wherein illustrated only is a portion constituting the liquid supply aperture, in order to clarify the features of the present invention.

Figure 1:
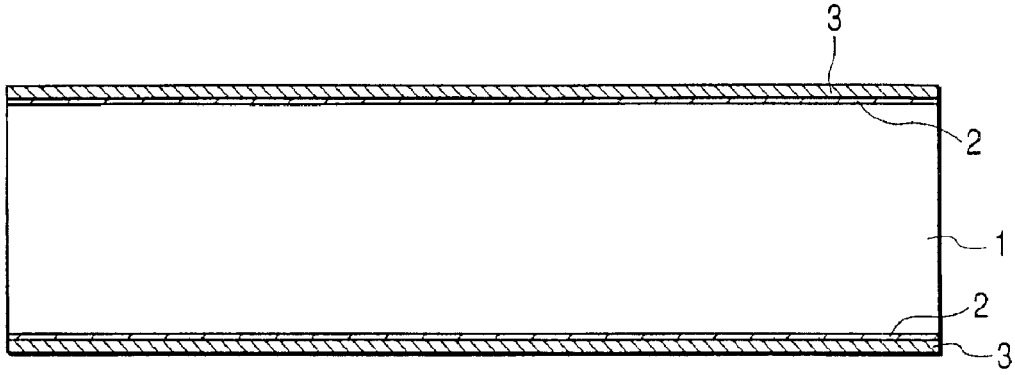
FIG. 1 is a schematic view showing a step in the method of the present invention for producing the liquid discharge head and showing a state where a silicon oxide film and a silicon nitride film are formed on a silicon substrate.
Figure 2:
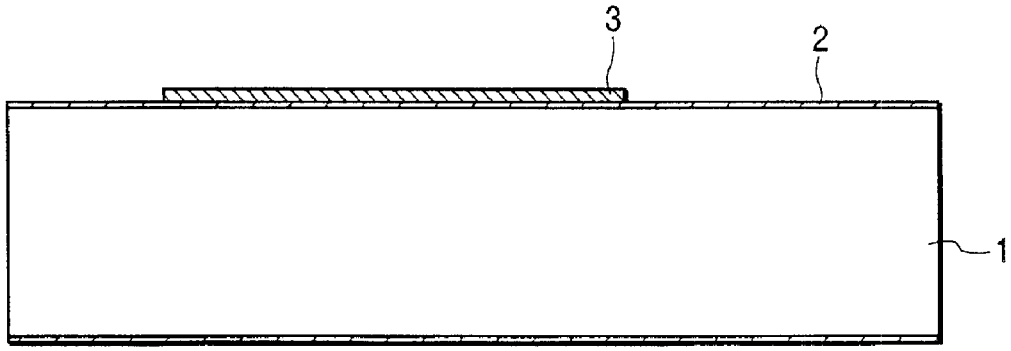
FIG. 2 is a schematic view showing a step in the method of the present invention for producing the liquid discharge head and showing a state where the silicon nitride film is patterned for forming an active area.

In the present embodiment, there is employed, as a substrate 1, a p-type silicon substrate of a thickness of 625 μm having a crystalline orientation of 100, and the silicon substrate 1 is subjected to thermal oxidation to form a silicon oxide film 2 of a thickness of 100 to 500 Å on the top side and rear side of the substrate. Then a silicon nitride film 3 of a thickness of 1000 to 3000 Å on the silicon oxide film by reduced pressure CVD (FIG. 1). Then the silicon nitride film 3 is patterned into a desired pattern corresponding to the aperture width of the liquid supply aperture on the top side, and the silicon nitride film 3 deposited on the rear side is removed (FIG. 2).

Figure 3:
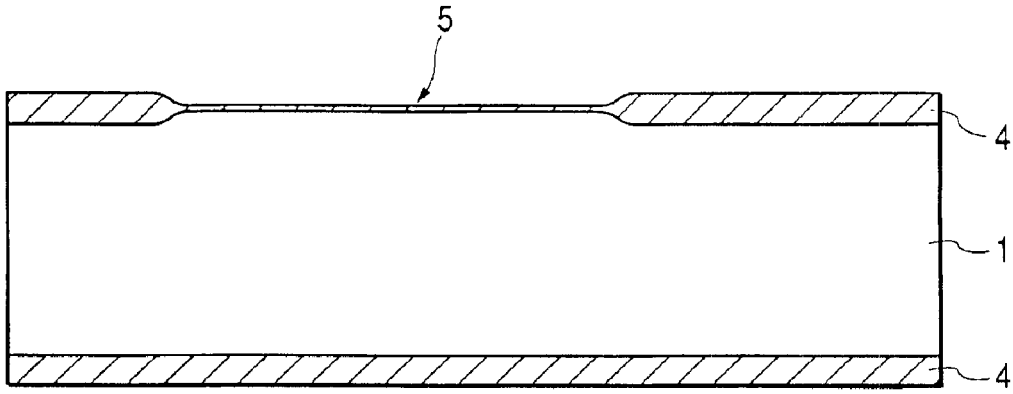
FIG. 3 is a schematic view showing a step in the method of the present invention for producing the liquid discharge head and showing a state where a silicon oxide film is formed in a portion other than the active area.

The thermal oxidation is executed to form a silicon oxide film 4 of a thickness of 6000 to 12000 Å. In this operation, an area 5 under the patterned silicon nitride film 3 (such area being hereinafter called active area) is not oxidized but the area lacking the silicon nitride film is selectively oxidized (FIG. 3).

Figure 4:
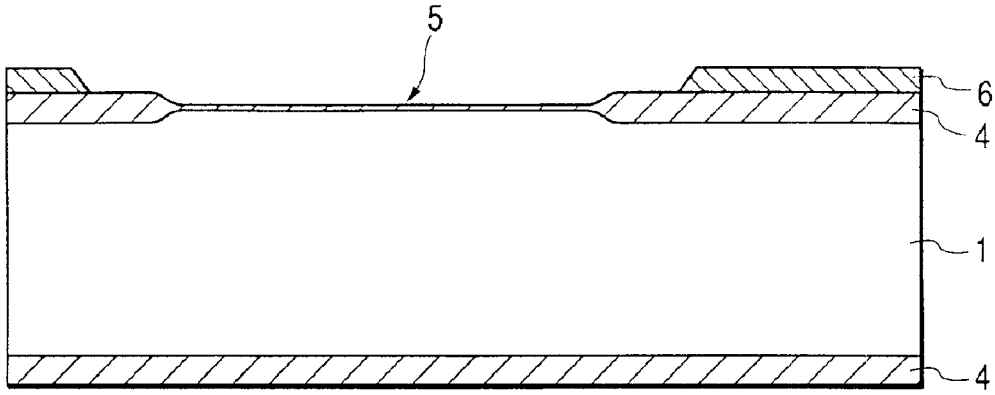
FIG. 4 is a schematic view showing a step in the method of the present invention for producing the liquid discharge head and showing a state where an interlayer film is formed.

Then an interlayer film 6, such as a PSG film or a BPSG film, for the wiring electrode is deposited with a thickness of 5000 to 10000 Å and is patterned into a desired shape (FIG. 4). Then an Al—Cu film (not shown) for constituting the wiring electrode is deposited and is patterned into a desired shape (FIG. 4). In this state, there is completed an active element for achieving liquid discharges. Since such active element and the preparation thereof are not directly related to the present invention, the active element is not illustrated and the steps required for preparation thereof are also omitted.

Figure 5:
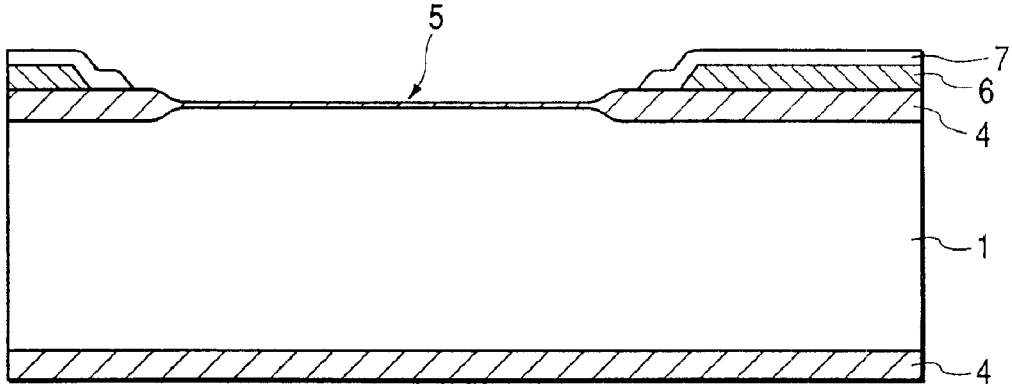
FIG. 5 is a schematic view showing a step in the method of the present invention for producing the liquid discharge head and showing a state where a plasma oxide film is deposited and patterned.

Ten a plasma oxide film of a thickness of 8000 to 18000 Å is deposited by plasma CVD and is patterned into a desired shape (FIG. 5).

Then P (phosphor) ions are implanted (as shown by an arrow 31) into the active area 5 under an acceleration energy of 120 keV and with a dose of $1\times10^{15}$ to $1\times10^{16}$ ion/cm$^2$, utilizing the silicon oxide film 4 of 6000 to 12000 Å as a mask.

Figure 6:
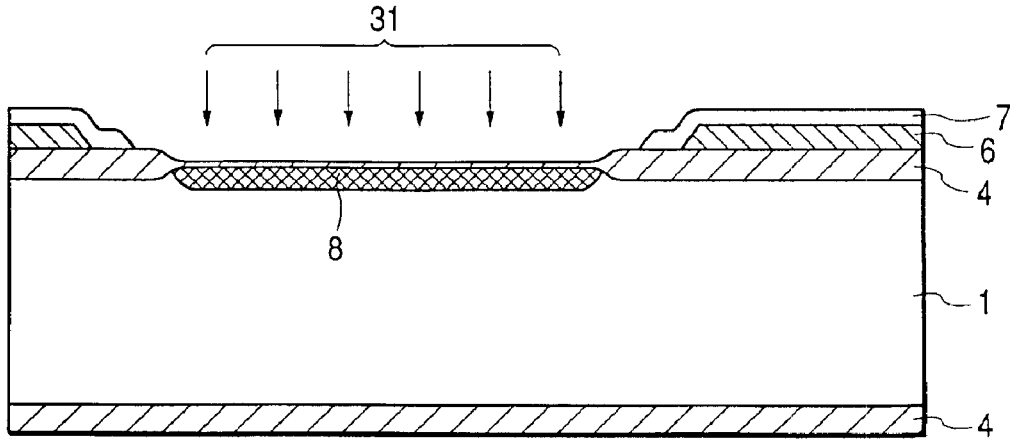
FIG. 6 is a schematic view showing a step in the method of the present invention for producing the liquid discharge head and showing a state where ion implantation is executed in the active area to form an area where the Si crystalline structure is destructed.

Thus the Si crystalline structure in the active area 5 is destructed over a depth of about 2000 Å, thereby forming an area 8 lacking anisotropy and showing a very high etching rate (FIG. 6). In the foregoing explanation there are employed P (phosphor) ions, but there may be employed any substance capable of destructing the Si crystalline structure. Also thus destructed crystalline structure is not restored since the succeeding process is executed at a relatively low temperature not exceeding 400° C.

Figure 7:
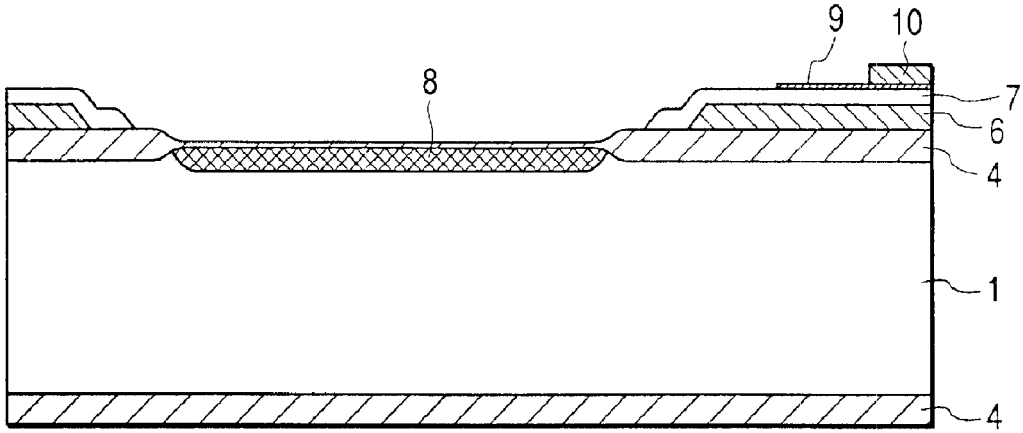
FIG. 7 is a schematic view showing a step in the method of the present invention for producing the liquid discharge head and showing a state where a heat-generating resistor constituting the discharge energy generating element is formed.

Then TaN 9, constituting the heat generating resistor, is deposited with a thickness of 200 to 1000 Å by reactive sputtering, and is patterned into a desired shape. Subsequently an Al—Cu film 10, constituting the wiring electrode for the heat generating resistor, is deposited thereon and patterned into a desired shape (FIG. 7).

Figure 8:
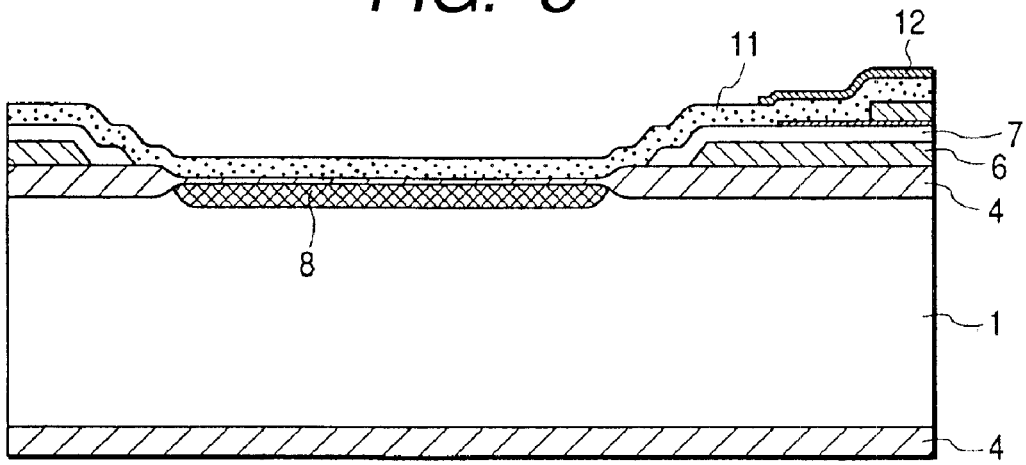
FIG. 8 is a schematic view showing a step in the method of the present invention for producing the liquid discharge head and showing a state where a protective film and an anticavitation film are formed.

Then a silicon nitride film 11 constituting a protective film is deposited with a thickness of 4000 to 12000 Å by plasma CVD, and an anticavitation Ta film 12 is deposited thereon with a thickness of 500 to 6000 Å by sputtering and is patterned into a desired shape. Then the silicon nitride film 11 is formed into a lead electrode pattern (FIG. 8).

Figure 9:
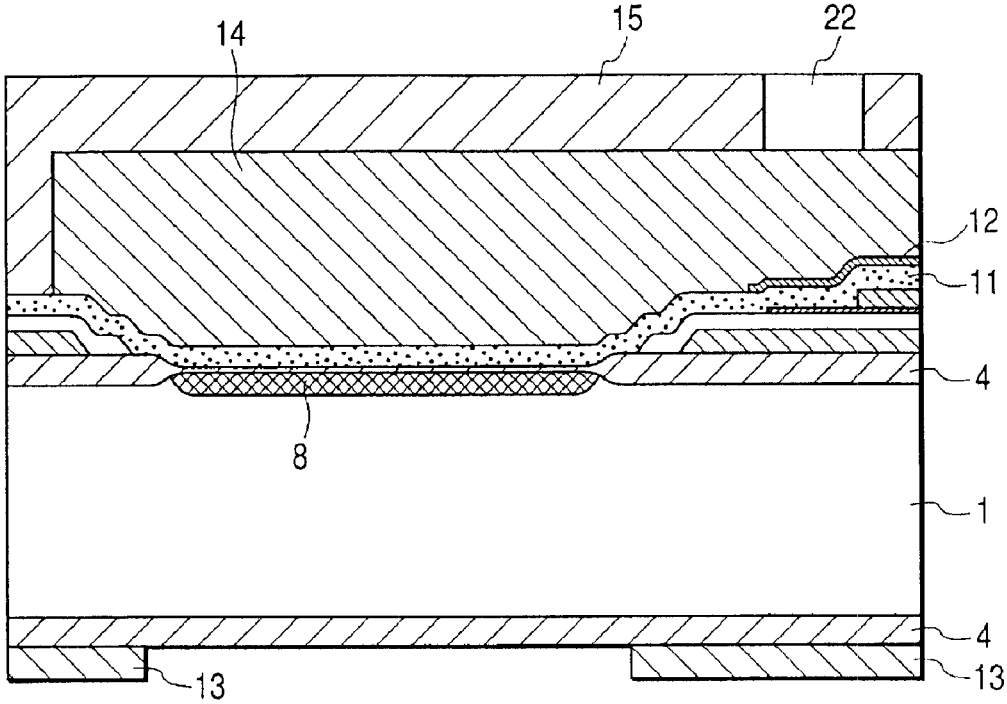
FIG. 9 is a schematic view showing a step in the method of the present invention for producing the liquid discharge head and showing a state where a liquid flow path and a discharge port are formed and an etching mask is formed on the rear side.

Then there is initiated a process for forming the nozzle portion for forming a discharge port. After an etching mask material 13 for anisotropic Si etching is coated on the rear side, patterning is executed to remove the etching mask material 13 in a portion where the liquid supply aperture is to be formed. Then, a nozzle mold material 14 constituting the liquid flow path is coated and patterned on the top side, and a covering resin layer 15, constituting the head, is coated thereon and patterned. In the covering resin layer 15, there is formed a discharge port 22 by suitable means (FIG. 9).

Figure 10:
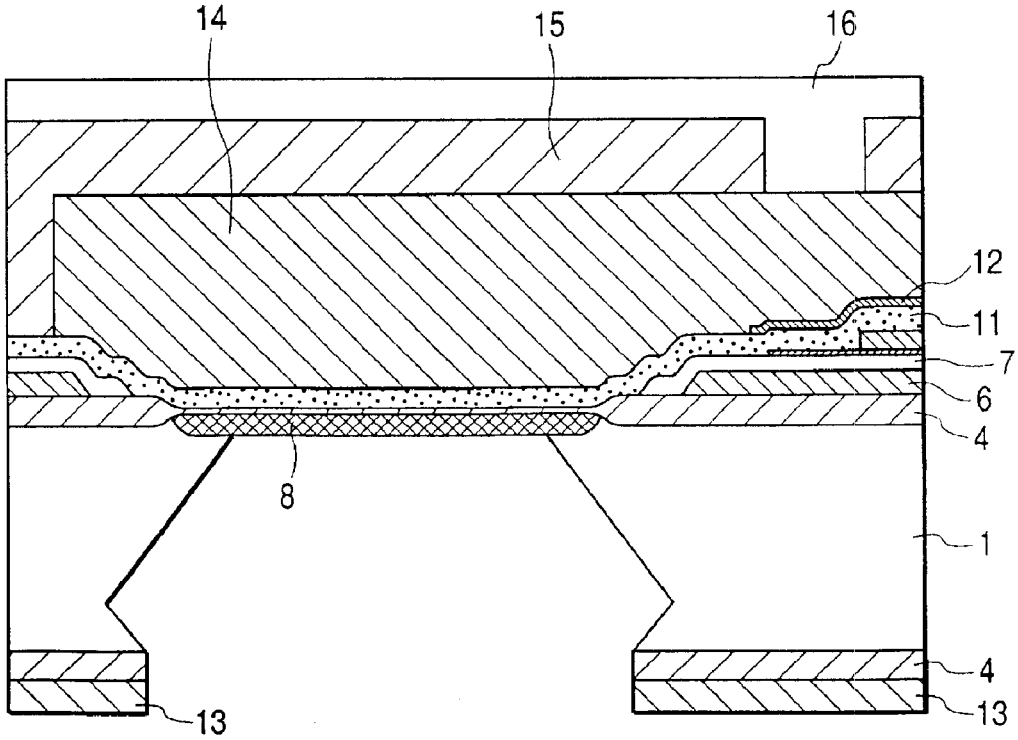
FIG. 10 is a schematic view showing a step in the method of the present invention for producing the liquid discharge head and showing a state where anisotropic etching is executed on the silicon substrate.

Then, as shown in FIG. 10, a surface protecting material 16 for the anisotropic etching is coated on the top side and the silicon oxide film 4 in the aperture portion on the rear side is removed with buffered hydrofluoric acid, and anisotropic Si etching is subsequently executed with TMAH aqueous solution of 80 to 90° C. FIG. 10 shows a state where the anisotropic etching proceeds to the area 8 where the Si crystalline structure is destructed. In this operation, the width of the liquid supply aperture shows fluctuation when the etching proceeds to the area 8 where the Si crystalline structure is destructed, because of unevenness in the size and density of the defects in Si as explained in the foregoing. However, as will be explained later in more details, no difficulty arises as long as the etching arrives at the area 8 where the Si crystalline structure is destructed and the width of the liquid supply aperture at the arrival of etching is contained within the aforementioned area 8.

Figure 11:
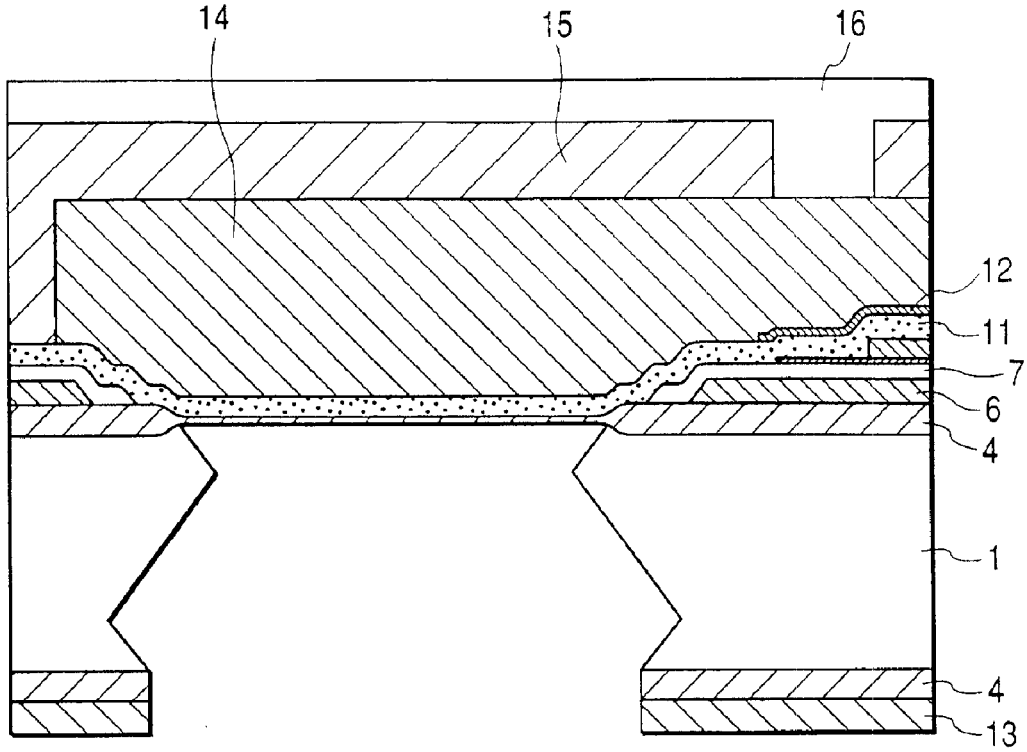
FIG. 11 is a schematic view showing a step in the method of the present invention for producing the liquid discharge head and showing a state where etching is executed in the area in which the Si crystalline structure is destructed.

Thereafter the etching is further executed in the area 8 where the Si crystalline structure is destructed. In such area 8 where the Si crystalline structure is destructed, the etching rate is higher by several times to several hundred times in comparison with other areas and the etching proceeds promptly without showing any dependence on the crystal orientation. As a result, the finally etched shape becomes as shown in FIG. 11 and the aperture width of the liquid supply aperture on the top side becomes substantially equal to the width of the Si crystalline structure destructed area 8. Consequently, even if the size of the liquid supply aperture shows fluctuation in the initial stage of etching by the unevenness in the size and density of the defects in Si, such fluctuation does not influence the final aperture width of the liquid supply aperture on the top side.

Figure 12:
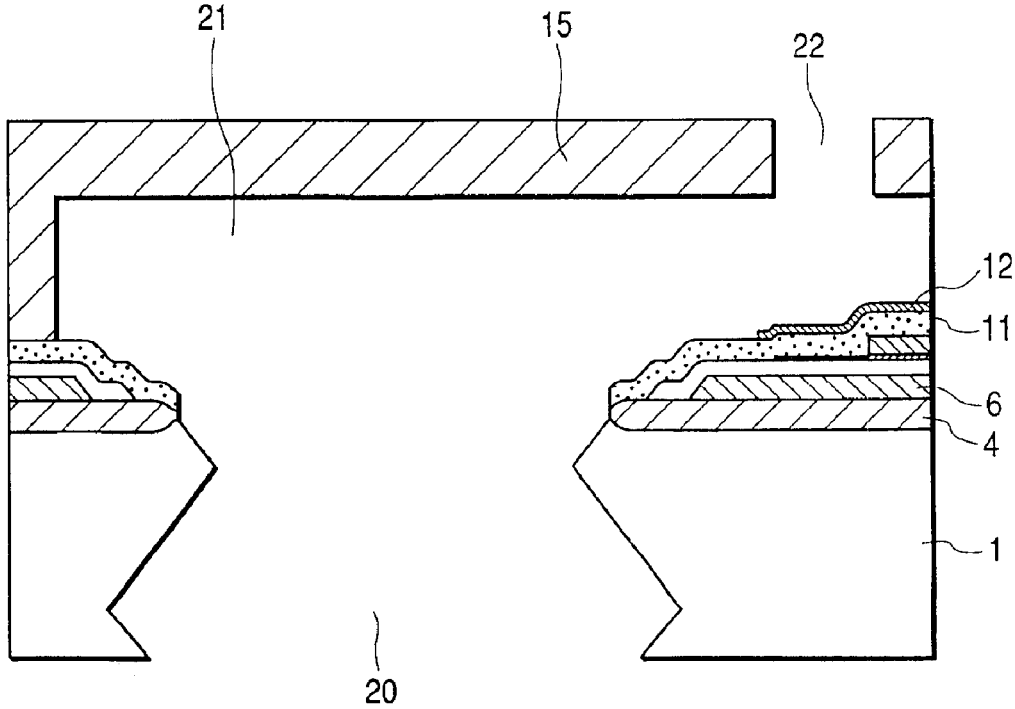
FIG. 12 is a schematic view showing a step in the method of the present invention for producing the liquid discharge head and showing a state where a liquid supply aperture, a liquid flow path and a discharge port are formed.

After the completion of anisotropic etching, the etching mask material 13 and the oxide film 14 on the rear side are removed, and the oxide and nitride films present in the liquid supply aperture are removed by dry etching with fluorine and oxygen containing gas. Then the surface protective material 16 for anisotropic etching is removed, and the nozzle mold material 14 for constituting the liquid flow path is dissolved out with solvent (FIG. 12). In this manner, as shown in FIG. 12, there is completed a liquid discharge head including the liquid supply aperture 20, liquid flow path 21 and discharge port 22 (semiconductor device having liquid discharging function).

As explained in the foregoing, the liquid supply aperture is formed by destructing the Si crystalline structure in the area for forming the liquid supply aperture on the top side of the silicon substrate of surfacial crystalline orientation 100, then executing anisotropic etching from the rear side of the substrate to the area where the crystalline structure is destructed, and eliminating the area where the crystalline structure is destructed by etching, utilizing the property of such area in which the etching rate is very high and the etching is isotropic. In this manner the aperture width of the liquid supply aperture on the top side can be made substantially equal to the width of the area where the Si crystalline structure is destructed, namely matching the design dimension determined by patterning on the top side of the Si substrate, whereby the aperture width of the liquid supply aperture on the top side can be formed precisely regardless of the state of the Si substrate. Consequently, the distance between the end of the liquid supply aperture and the discharge energy generating element can be made precisely according to the design, and the liquid supply characteristics can be made uniform among the discharge ports, whereby satisfactory operational performance can be obtained in the liquid discharge head.

Figure 13:
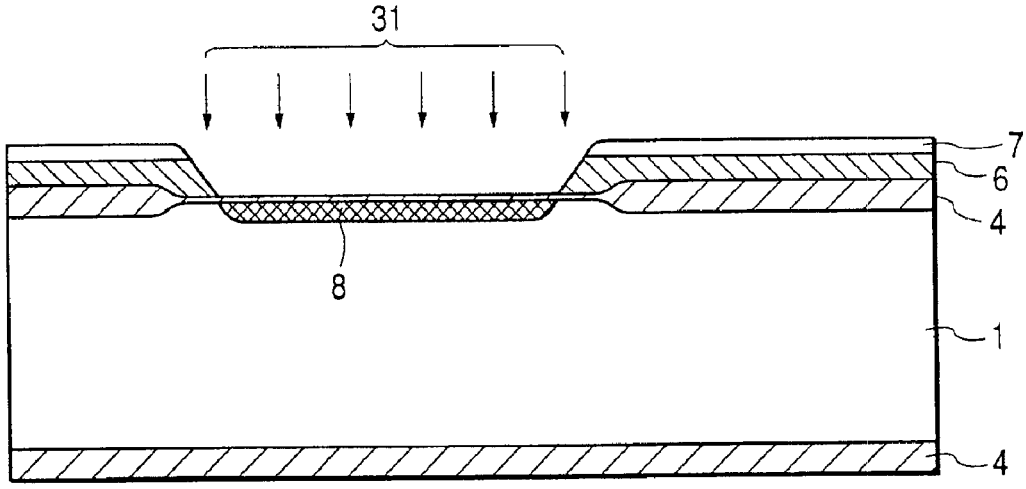
FIG. 13 is a schematic view showing a step in the method of the present invention for producing the liquid discharge head and showing another embodiment of forming a crystalline structure destructed area by ion implantation.
Figure 14A:
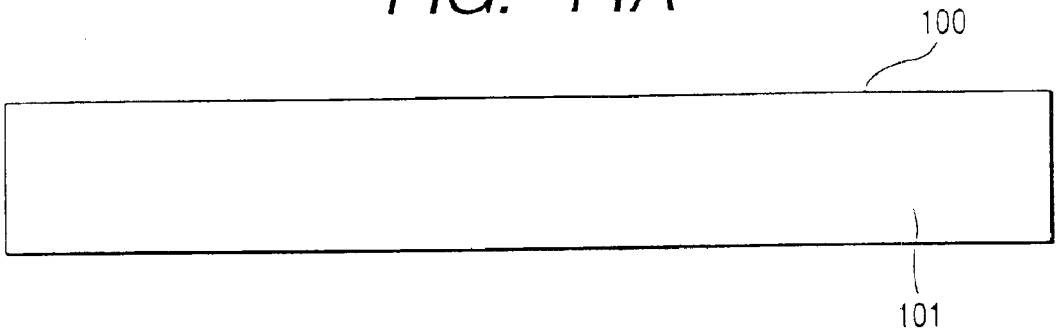
PRIOR ART FIG. 14A
FIGS. 14A, 14B and 14C are schematic views showing issues in the formation of a penetrating hole in the silicon substrate by anisotropic etching.
Figure 14B:
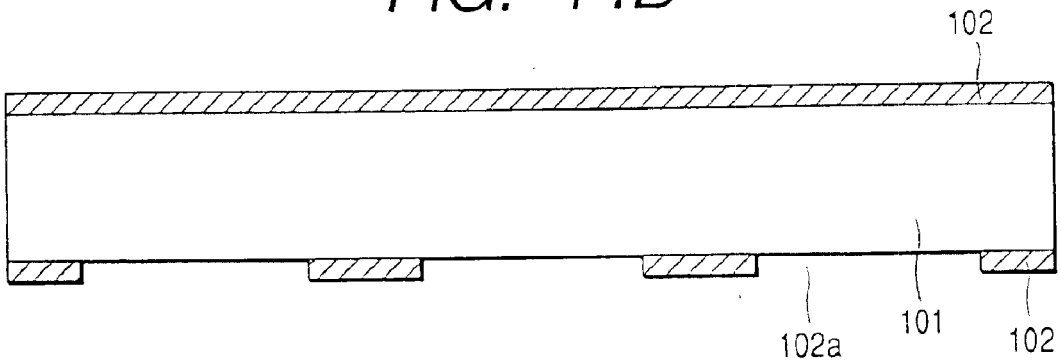
PRIOR ART FIG. 14B
Figure 14C:
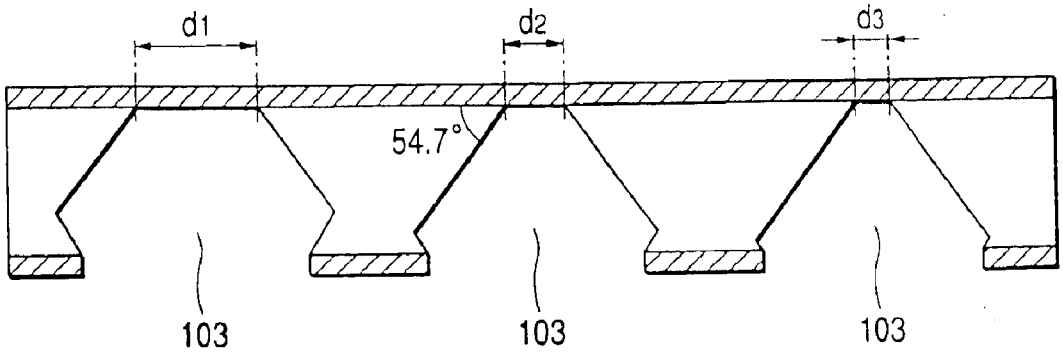
PRIOR ART FIG. 14C
Figure 15:
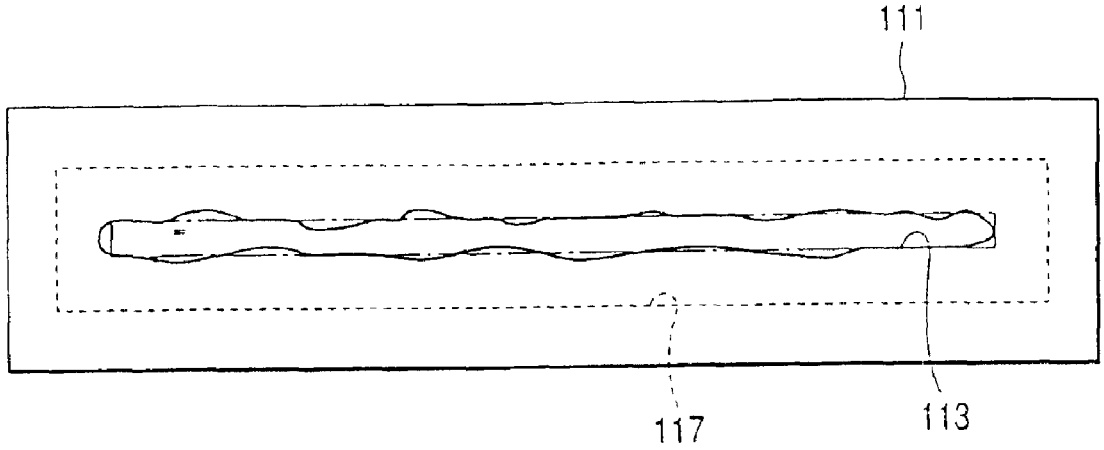
PRIOR ART FIG. 15
FIG. 15 is a schematic view showing the state of the top side aperture of the liquid supply aperture in the conventional liquid discharge head of side shooter type.
Figure 16:
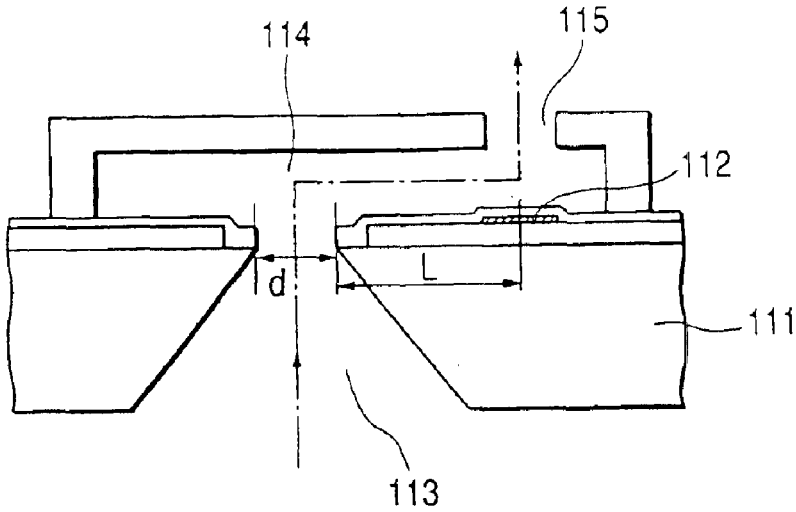
PRIOR ART FIG. 16
FIG. 16 is a schematic view showing the configuration of a conventional liquid discharge head of side shooter type.

In the foregoing embodiment, there has been explained the formation of the crystalline structure destructed area 8 by ion implantation utilizing the silicon oxide film 4 formed in the desired portion as a mask, but such mask is not limited to a silicon oxide film and the structure of such mask is not limited to that explained in the foregoing embodiment. For example, it is also possible to pattern the interlayer film 6 and the plasma oxide film 7 in a form shown in FIG. 13 and to execute ion implantation 31 utilizing such films as a mask. In the configuration shown in FIG. 13, the interlayer film 6 such as PSG or BPSG film and the plasma oxide film 7 serve as the mask. Also the material of the film serving as the mask is not limited to that explained in the foregoing embodiment, and there may also be employed other films such as a silicon nitride film.

What is claimed is:

1. A method for producing a liquid discharge head provided with a discharge port for discharging liquid, a liquid flow path communicating with said discharge port, and a silicon substrate including a discharge energy generating element for generating energy for liquid discharge and a liquid supply aperture for supplying said liquid flow path with the liquid, the method comprising:

a step of forming an anisotropic etching stop layer in a portion wherein the liquid supply aperture is to be formed on a top side of said substrate;

a step of forming an insulation layer on said anisotropic etching stop layer;

a step of destroying a crystalline structure under said etching stop layer in a liquid supply aperture forming portion on the top side of said substrate, utilizing said insulation layer as a mask, a step of forming, on a rear side of said substrate, an etching mask layer having an aperture corresponding to the liquid supply aperture forming portion on the top side, a step of etching said substrate by anisotropic etching from the aperture until an area where the crystalline structure is destroyed is exposed; and a step of further etching the area where the crystalline structure is destroyed, which has been exposed by said anisotropic etching step, thereby exposing said anisotropic etching stop layer; and a step of eliminating the exposed anisotropic etching stop layer, wherein the destruction of the crystalline structure in the liquid supply aperture forming portion on the top side of said substrate is executed by implantation of impurity ions.

2. A method of producing the liquid discharge head according to claim 1, wherein, in the destruction of the crystalline structure in the liquid supply aperture forming portion on the top side of said substrate, executed by implantation of impurity ions, a silicon oxide film, a PSG film, a BPSG film, a plasma oxide film or the like, formed in a desired portion on a surface of the substrate, is utilized as a mask.

3. A method of producing the liquid discharge head according to claim 2, wherein the anisotropic etching of said silicon substrate and the etching of the area where the crystalline structure is destroyed are executed with TMAH aqueous solution.

4. A method of producing the liquid discharge head according to any of claims 1, 2 and 3, wherein the aperture width of said liquid supply aperture on the top side of said substrate is determined by the area on the top side of said substrate where the crystalline structure is destroyed.

5. A method of producing the liquid discharge head according to any of claims 1, 2 and 3, wherein said silicon substrate has a surficial crystalline orientation of 100.

6. A method of producing the liquid discharge head according to claim 4, wherein said silicon substrate has a surficial crystalline orientation of 100.

* * * * *

UNITED STATES PATENT AND TRADEMARK OFFICE

CERTIFICATE OF CORRECTION

PATENT NO. : 6,875,365 B2
DATED : April 5, 2005
INVENTOR(S) : Hidenori Watanabe et al.

It is certified that error appears in the above-identified patent and that said Letters Patent is hereby corrected as shown below:

Title page,
Item [57], ABSTRACT,
Line 9, “apertures is” should read -- aperture is --.

Column 1,
Line 46, “layers” should read -- layer --.
Line 49, “is anisotropically etching” should read -- is anisotropically etched --.

Column 5,
Line 65, “Ten” should read -- Then --.

Column 8,
Line 13, “mask,” should read -- mask; --.
Line 17, “side,” should read -- side; --.
Line 21, “and” should be deleted.

Signed and Sealed this

Twenty-fourth Day of January, 2006

JON W. DUDAS
*Director of the United States Patent and Trademark Office*